US007353624B2

(12) United States Patent
Chung et al.

(10) Patent No.: US 7,353,624 B2
(45) Date of Patent: Apr. 8, 2008

(54) CLOTHING DRYING MACHINE AND METHOD FOR SENSING DRYNESS LEVEL USING THE SAME

(75) Inventors: Young Suk Chung, Suwon-Si (KR); Su Young Byun, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 227 days.

(21) Appl. No.: 11/223,965

(22) Filed: Sep. 13, 2005

(65) Prior Publication Data

US 2006/0096117 A1 May 11, 2006

(30) Foreign Application Priority Data

Nov. 11, 2004 (KR) ..... 10-2004-0091830

(51) Int. Cl.
*F26B 3/00* (2006.01)

(52) U.S. Cl. ..... 34/446; 34/486; 34/491; 34/550; 34/562

(58) Field of Classification Search ..... 34/445, 34/446, 486, 491, 550, 562
See application file for complete search history.

(56) References Cited

U.S. PATENT DOCUMENTS 3,762,064 A 10/1973 Offutt
4,385,452 A 5/1983 Deschaaf et al.
4,477,982 A 10/1984 Cotton

FOREIGN PATENT DOCUMENTS

KR 2002-0062446 A 7/2002

*Primary Examiner*—Jiping Lu
(74) *Attorney, Agent, or Firm*—Sughrue Mion, PLLC

(57) ABSTRACT

A clothing drying machine, which terminates drying operation when a dryness level of the drying machine reaches a target level desired by a user, and a method for sensing the dryness level using the same. The method includes counting the frequency of a case, in which voltage sensed by an electrode sensor, in which the voltage varies according to moisture content of clothing, is more than a predetermined reference voltage; and terminating drying operation when the frequency counted by the counting unit for a predetermined reference time is in the range of one of predetermined dryness levels.

8 Claims, 6 Drawing Sheets

Fig 5

| DRYNESS LEVEL | REMAINING MOISTURE CONTENT(%) | FREQUENCY OF COUNTING FOR 1 MINUTE |
|---|---|---|
| Damp Dry | 12 ~ 25 | 200~400 |
| Less Dry | 5 ~ 20 | 100~200 |
| Normal Dry | 3 ~ 5 | 0 |
| More Dry | 1 ~ 3 | 0 |
| Very Dry | 1 ~ 2 | 0 |

CLOTHING DRYING MACHINE AND METHOD FOR SENSING DRYNESS LEVEL USING THE SAME

CROSS-REFERENCE TO RELATED APPLICATION

This application claims the benefit of Korean Patent Application No. 2004-91830, filed Nov. 11, 2004, in the Korean Intellectual Property Office, the disclosure of which is incorporated herein by reference.

BACKGROUND OF THE INVENTION

1. Field of the Invention

The present invention relates to a clothing drying machine and a method for sensing a dryness level using the same, and more particularly, to a clothing drying machine, which performs drying operation in various dryness levels and a method for sensing a dryness level using the clothing drying machine.

2. Description of the Related Art

Generally, a clothing drying machine includes a housing forming an external structure, a drum installed in the housing for containing laundry to be dried, a heating duct for generating hot air to be supplied to the drum, a hot air inlet channel for guiding the hot air generated form the heating duct to the drum, and a hot air outlet channel for guiding the hot air discharged from the drum to the outside.

The drum is rotatably installed in the housing, and an air blast fan for generating force for flowing the hot air is installed in the hot air outlet channel. The hot air circulates into the drum and the duct by the operation of a driving motor for simultaneously driving the drum and the air blast fan, thereby drying the laundry.

A conventional clothing drying machine, which is disclosed by Korean Laid-open Publication No. 2002-62446, senses a dryness level of clothing using an electrode sensor and a thermistor. The electrode sensor determines the dryness level of the clothing according to a sensed voltage using a principle, in which the voltage is increased when laundry having a high humidity contacts a metal plate, and the thermistor allows control of the drying of the clothing using a principle in which electric resistance varies according to a variation of temperature. That is, the thermistor determines a dryness level of the clothing by sensing the temperature of air discharged from the drum to the outside. As shown in FIGS. 1 and 2, when a driving motor and a heater are driven after clothing to be dried is supplied to the inside of a drum of the drying machine, and a drying operation starts, the thermistor senses a temperature (T) of discharged air after the clothing is dried, and the electrode sensor senses a dried state value (V) of the clothing in the drum.

When the drying of the clothing is in progress (S10), the dried state value (V) of the clothing and the temperature (T) of the air vary based on the curves of V and T versus time (t) shown in FIG. 2. A control unit periodically senses the dried state value (V) of the clothing (S30) and the temperature (T) of the air (S20), and determines whether or not the temperature (T) of the air reaches a predetermined upper limit (T1) (S40). When it is determined that the temperature (T) of the air reaches the predetermined upper limit (T1), the control unit stops the operation of the heater (S50), and when it is determined that the temperature (T) of the air is less than a predetermined lower limit (T2) (S60), the control unit turns on the heater (S70). The above procedure is repeated until it is sensed that the dried state value (V) of the clothing is more than 5V (S80). When the dried state value (V) of the clothing is more than 5V, it is determined that the drying of the clothing is completed and the drying operation is terminated (S90).

In the above-described conventional method for sensing a dryness level of clothing, when the temperature (T) of the air reaches the predetermined upper limit (T1) and the thermistor starts its control operation, the clothing has been comparatively highly dried. Accordingly, the above conventional method cannot cope with the situation in which a user wants a low dryness level of the clothing so that the clothing has a high remaining moisture content.

Further, if a dryness level of the clothing is determined using a voltage value inputted to the electrode sensor, the voltage value momentarily may fluctuate widely. Accordingly, in this case, it is difficult to sense a precise dryness level of the clothing.

SUMMARY OF THE INVENTION

Therefore, one aspect of the invention is to provide a clothing drying machine, which terminates drying operation when a dryness level of clothing reaches a target level desired by a user, and a method for sensing the dryness level using the same.

In accordance with one aspect, the present invention provides a clothing drying machine including: an electrode sensor, in which voltage varies according to moisture content of laundry; a counting unit for counting the frequency of a case, in which the voltage sensed by the electrode sensor is more than a predetermined reference voltage; and a control unit for terminating drying operation when the frequency counted by the counting unit for a predetermined reference time is in the range of one of predetermined dryness levels.

In accordance with another aspect, the present invention provides a method for sensing a dryness level using a clothing drying machine including: counting the frequency of a case, in which voltage sensed by an electrode sensor, in which the voltage varies according to moisture content of laundry, is more than a predetermined reference voltage; and terminating the drying operation when the frequency counted by the counting unit for a predetermined reference time is in the range of one of predetermined dryness levels.

In accordance with yet another aspect, the present invention provides a method for sensing a dryness level using a clothing drying machine including: allowing an electrode sensor, in which voltage varies according to moisture content of laundry, to sense the voltage; and determining the dryness level corresponding to the frequency of a case, in which the sensed voltage is in a predetermine range.

BRIEF DESCRIPTION OF THE DRAWINGS

Aspects of the invention will become apparent and more readily appreciated from the following description of the exemplary embodiments, taken in conjunction with the accompanying drawings in which:

FIG. 5 is a table stating the frequency of counting according to dryness levels in accordance with the exemplary embodiment of the present invention.

DETAILED DESCRIPTION OF THE EXEMPLARY EMBODIMENTS

Figure 1:
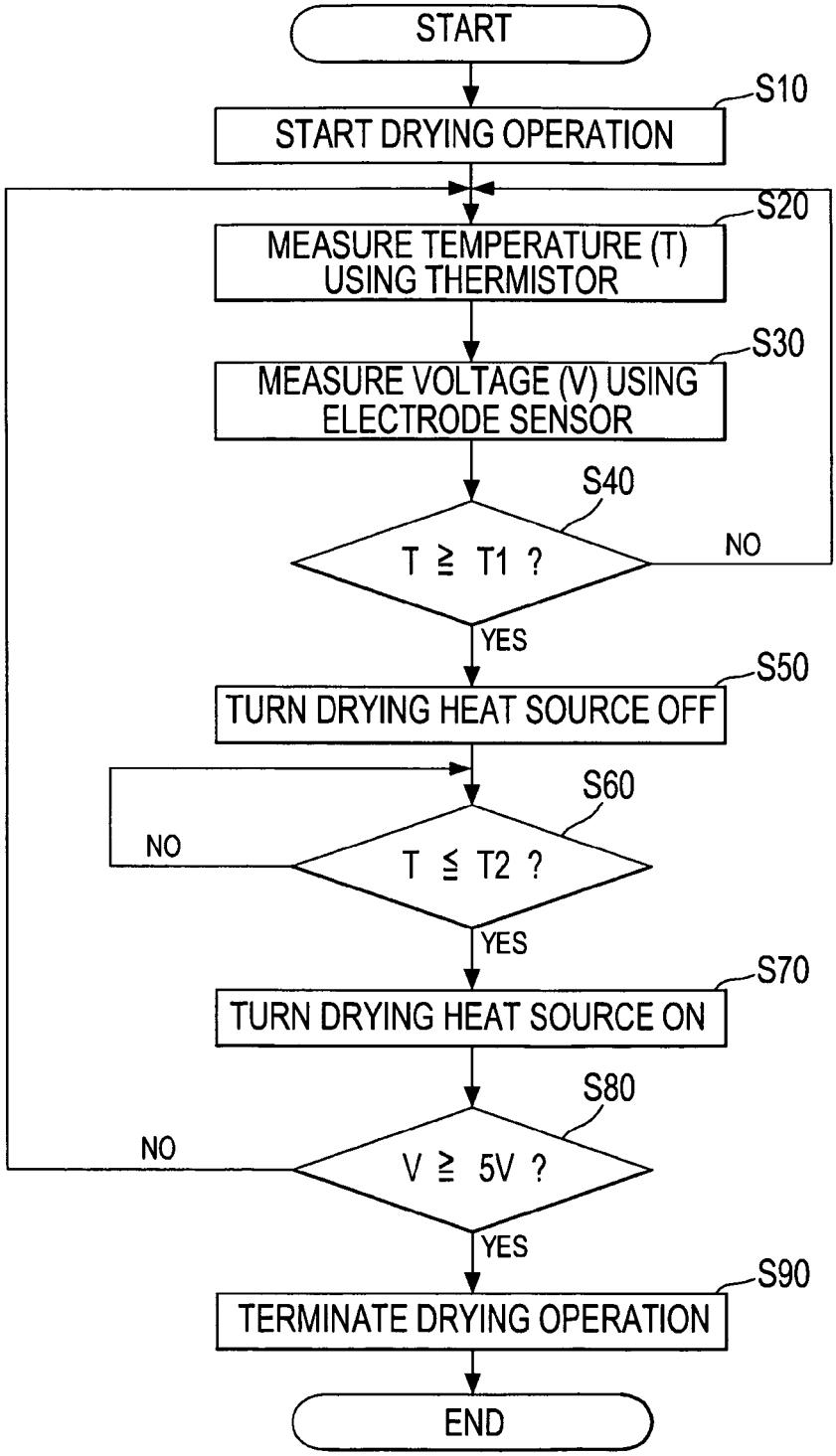
Fig 1 RELATED ART
FIG. 1 is a flow chart illustrating a conventional method for sensing a dryness level of a clothing drying machine.

Reference will now be made in detail to the exemplary embodiment of the present invention, an example of which is illustrated in the accompanying drawings, wherein like reference numerals refer to like elements throughout. The exemplary embodiment is described below to explain the present invention by referring to the annexed drawings.

Figure 3:
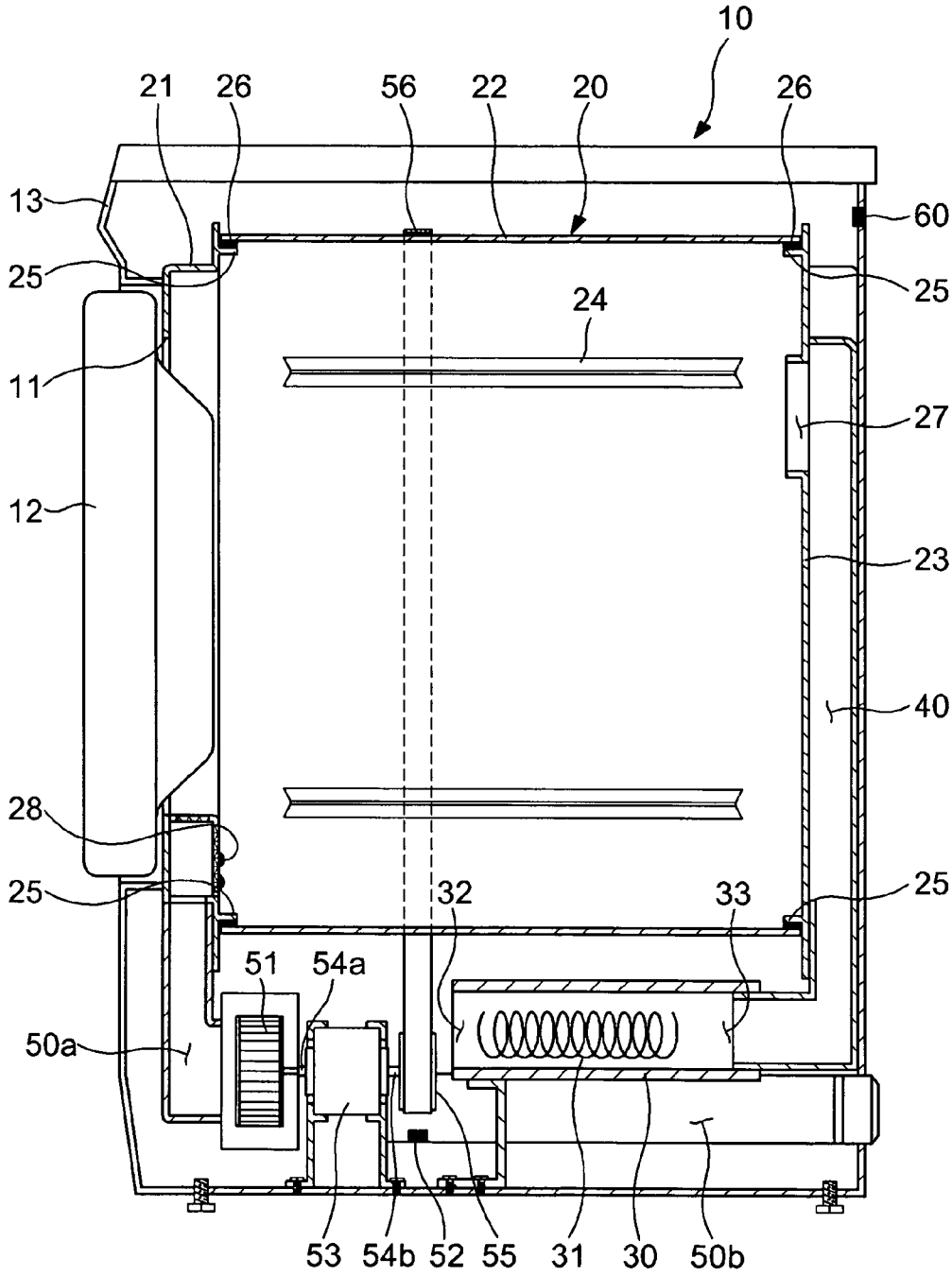
FIG. 3 is a sectional view of a clothing drying machine in accordance with an exemplary embodiment of the present invention.
Figure 4:
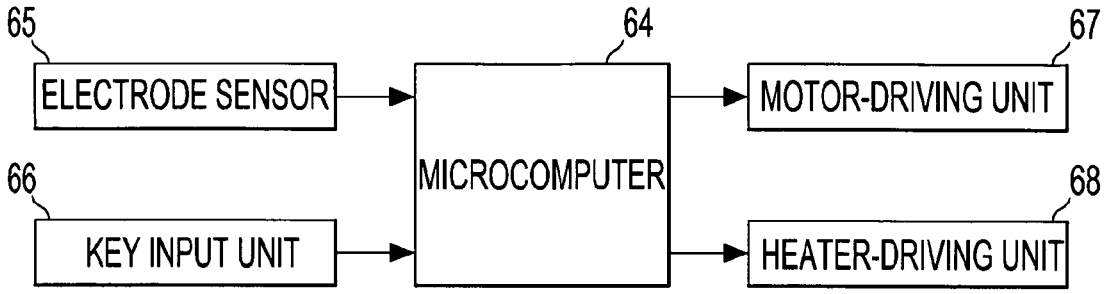
FIG. 4 is a block diagram illustrating elements of the clothing drying machine shown in FIG. 3.

As shown in FIGS. 3 and 4, a clothing drying machine in accordance with an exemplary embodiment of the present invention includes a housing 10 forming an external structure, a drum 20 having a cylindrical structure installed in the housing 10 for containing laundry to be dried, a heating duct 30 for generating hot air to be supplied to the drum 20, a hot air inlet channel 40 for guiding the hot air generated from the heating duct 30 to the drum 20, hot air outlet channels 50*a* and 50*b* for guiding the hot air, discharged from the drum 20, to the outside of the housing 10, and an outdoor air temperature sensor 60 for sensing the temperature of outdoor air.

An opening 11 for putting laundry into and taking laundry out of the drying machine is formed through the central portion of the front surface of the housing 10, and a door 12 for opening and closing the opening 11 is hinged to one side of the opening 11. A key input unit 66 (in FIG. 4) for controlling operations of all the elements and a control panel 13 having a display unit for displaying an estimated drying time and states of the operations of all the elements are installed on the upper portion of the front surface of the housing 10.

The drum 20 includes a front portion 21 provided with an opening formed through the central portion thereof towards the door 12, a rear portion 23 located in the rear portion of the inside of the housing 10 and provided with a hot air inlet 27 formed through the upper portion thereof, and a side portion 22 connecting the front portion 21 and the rear portion 23. The side portion 22 can be rotated.

Two bar-shaped electrodes 28 extend in a transverse direction with respect to the front portion 21 and are provided with side surfaces protruded towards the rear portion 23 of the drum 20. The two bar-shaped electrodes are installed on the lower part of the front portion 21 and form an electrode sensor 65 (in FIG. 4).

Lifters 24 extended in a transverse direction of the side portion 22 are protruded from the inner cylindrical surface of the side portion 22 towards the center of the inside of the drum 20. The lifters 24 lift laundry and then drop the laundry according to the rotation of the side portion 22, thereby uniformly mixing the laundry. Both ends of the inside of the side portion 22 are supported by support portions 25 protruded from the front and rear portions 21 and 23 to the side portion 22. Sliding pads 26 are installed between the support portions 25 and both ends of the side portion 22 of the drum 20, thereby facilitating the sliding motion of the side portion 22 of the drum 20.

A heater 31 for heating air sucked from the inside of the housing 10 to the heating duct 30 is installed in the heating duct 30. An inlet 32 for sucking air in the housing 10 is formed through the front end of the heating duct 30, and an outlet 33 connected to the hot air inlet channel 40 so that the heated air is supplied to the drum 20 is formed through the rear end of the heating duct 30.

One end of the hot air inlet channel 40 is connected to the outlet 33 of the heating duct 30, and bent upwardly at the rear portion of the housing 10. The other end of the hot air inlet channel 40 is connected to the hot air inlet 27 of the rear portion 23 of the drum 20. The hot air outlet channels 50*a* and 50*b* are connected to the lower part of the front portion 21 of the drum 20, and communicate with the outside of the housing 10 along the bottom surface of the inside of the housing 10. An air blast fan 51 for supplying force for sucking and discharging the hot air and a discharged air temperature sensor 52 for sensing the temperature of the discharged air are installed in the hot air outlet channels 50*a* and 50*b*.

Accordingly, when the air blast fan 51 is rotated, hot air generated from the heating duct 30 is guided to the inside of the drum 20. The hot air, which is supplied to the inside of the drum 20, evaporates moisture contained in laundry, and is then discharged to the outside of the housing 10 through the hot air outlet channels 50*a* and 50*b*.

A driving motor 53 transmits rotary force to the air blast fan 51 and the side portion 22 of the drum 20. For this reason, driving shafts 54*a* and 54*b* of the driving motor 53 extend forwards and backwards. The air blast fan 51 is directly connected to the driving shaft 54*a*, which extends forwards, and a pulley 55 for driving the side portion 22 of the drum 20 is fixed to the other driving shaft 54*b*, which extends backwards. The pulley 55 is connected to the side portion 22 of the drum 20 by a motor-driven belt 56, thereby transmitting the rotary force of the driving motor 53 to the side portion 22 of the drum 20. Thus, the air blast fan 51 and the side portion 22 of the drum 20 are simultaneously rotated.

As shown in FIG. 4, the clothing drying machine of FIG. 3 further comprises an electrode sensor 65 installed so that laundry put into the drum 20 contacts the electrodes 28 (in FIG. 3), a motor-driving unit 67 for controlling the driving of the motor 53, a heater-driving unit 68 for controlling the driving of the heater 31, and a microcomputer 64 for measuring a dryness level of the laundry and controlling the overall operation of the clothing drying machine.

Figure 2:
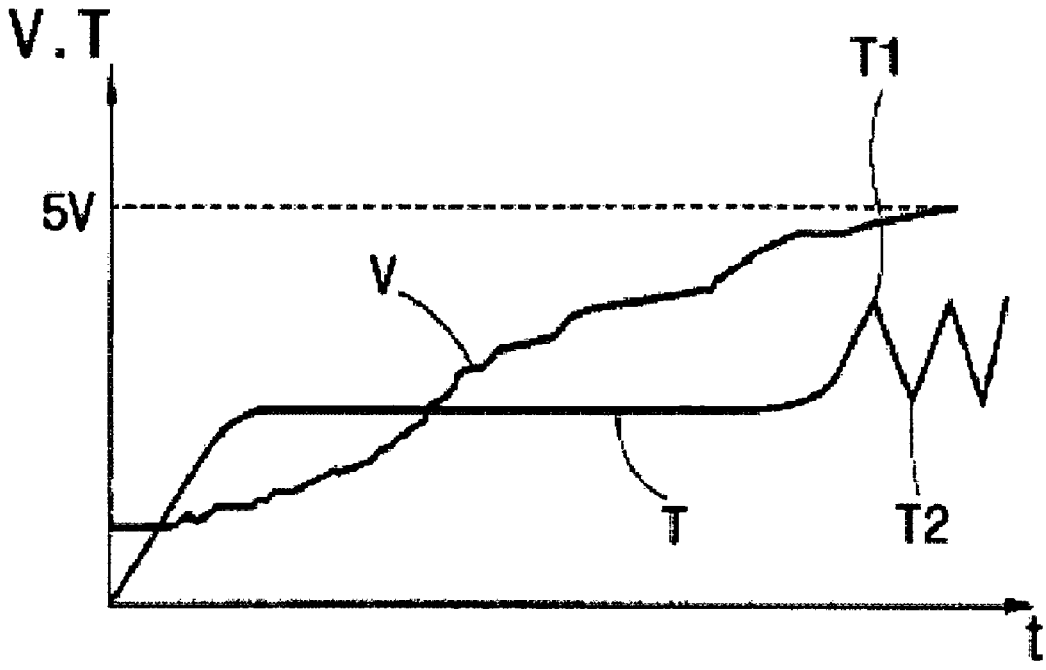
Fig 2 RELATED ART
FIG. 2 is a graph illustrating the conventional method.

The electrode sensor 65 includes the two bar-shaped electrodes 28 (in FIG. 2). When laundry containing moisture contacts the two electrodes 28 simultaneously, the electrode sensor 65 is electrically shorted, and fine and regular current flows in the electrode sensor 65. The resistance value of the electrode sensor 65 varies according to the moisture content of the laundry. When the moisture content of the laundry is high, the resistance value of the electrode sensor 65 is low, thereby causing current to smoothly flow in the electrode sensor 65. On the other hand, when the moisture content of the laundry is low, the resistance value of the electrode sensor 65 is high, thereby causing current not to smoothly flow in the electrode sensor 65.

The above current is received as a voltage by the microcomputer 64. The lower the moisture content of the laundry, the lower the voltage value inputted into the microcomputer 64. The microcomputer 64 sets a reference voltage (approximately 2~2.5V). When the voltage inputted from the electrode sensor 65 to the microcomputer 64 is more than the reference voltage, the microcomputer 64 recognizes the inputted voltage as the number "1", and when the voltage inputted from the electrode sensor 65 to the microcomputer 64 is not more than the reference voltage, the microcomputer 64 recognizes the inputted voltage as the number "0". Then, the microcomputer 64 counts the frequency of the number "1". The lower the moisture content of the laundry is, the smaller the frequency of counting the number "1" is.

Dryness of the clothing drying machine is divided into five levels according to the remaining moisture content of the laundry after drying. When the remaining moisture content of the laundry is 15~25%, the dryness level is set to "damp dry"; when the remaining moisture content of the laundry is 5~20%, the dryness level is set to "less dry"; when the remaining moisture content of the laundry is 3~5%, the dryness level is set to "normal dry"; when the remaining moisture content of the laundry is 1~3%, the dryness level is set to "more dry"; and when the remaining moisture content of the laundry is 1~2%, the dryness level is set to "very dry".

The above five dryness levels are distinguished from one another using the frequency of counting the number "1". FIG. 5 is a table stating the relation between the remaining moisture content and the frequency of counting the number "1" according to dryness levels. When the frequency of counting the number "1" for 1 minute is approximately 200~400, it is determined that the dryness level is "damp dry"; when the frequency of counting the number "1" for 1 minute is approximately 100~200, it is determined that the dryness level is "less dry"; and when the frequency of counting the number "1" for 1 minute is approximately 0, it is determined that the dryness level is higher than "normal dry".

Figure 6:
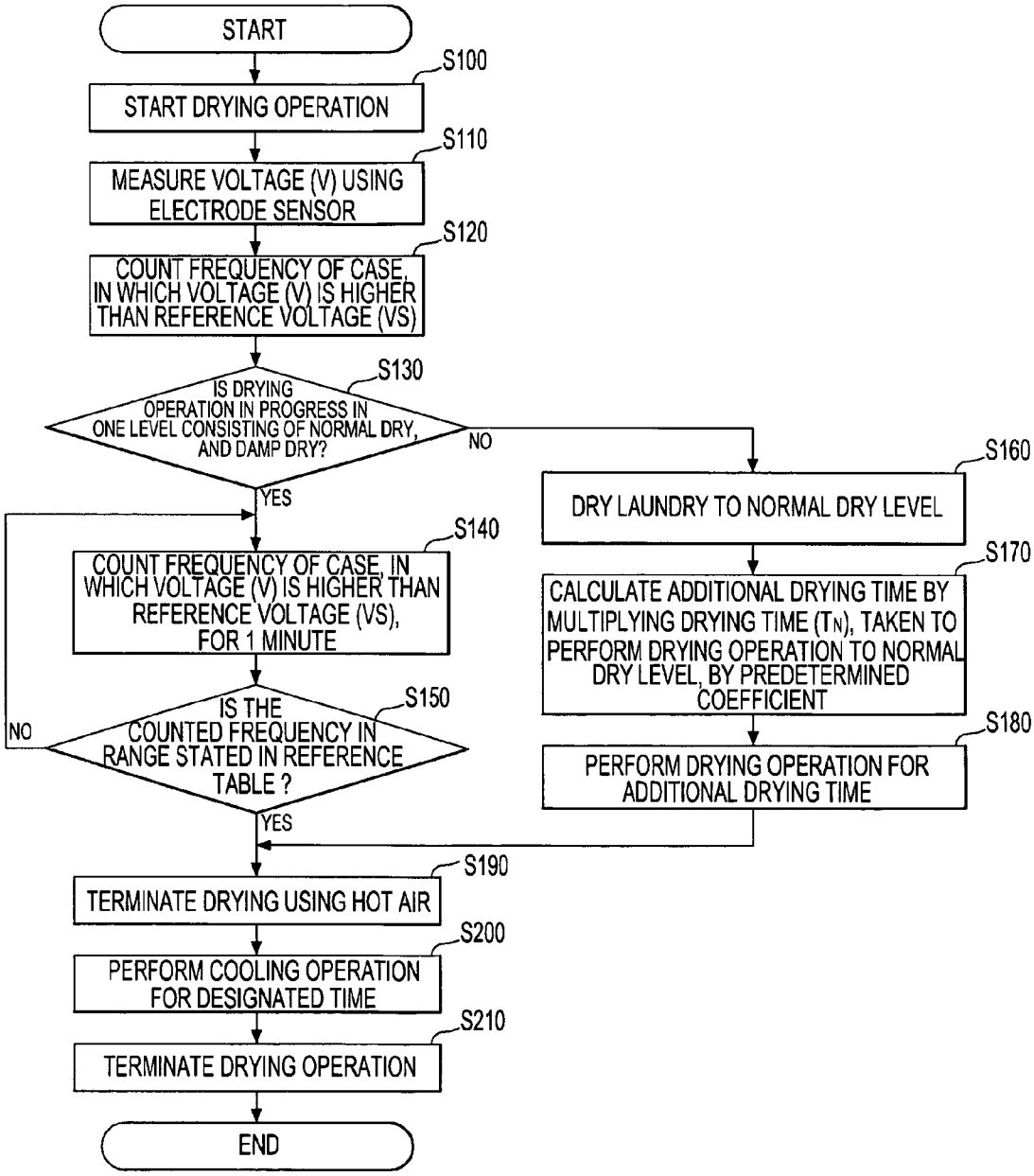
FIG. 6 is a flow chart illustrating operation of the clothing drying machine shown in FIG. 3.

In the case that the dryness level of clothing using the drying machine is performed higher than "normal dry", the degree of drying cannot be sensed only by the frequency of counting the number "1" using the electrode sensor 65. Hereinafter, with reference to FIG. 6, a method for sensing various dryness levels will be described.

When a user puts laundry to be dried into the drum 20, the user inputs a desired dryness level through the key input unit 66, and then presses a dry start button. The driving motor 53 and the heater 31 are operated and drying operation is started (S100).

When the drying operation is started, the electrode sensor 65 senses current according to the dried state of the laundry, and the current is inputted as voltage (V) to the microcomputer 64 (S110).

The microcomputer 64 compares the voltage (V), inputted from the electrode sensor 65, to a reference voltage (Vs: approximately 2~2.5V). When the inputted voltage (V) is higher than the reference voltage (Vs), the microcomputer 64 recognizes the inputted voltage (V) as the number "1", and when the inputted voltage (V) is not higher than the reference voltage (Vs), the microcomputer 64 recognizes the inputted voltage (V) as the number "0". Then, the microcomputer 64 counts the frequency of the number "1" (S120).

Thereafter, the microcomputer 64 determines whether or not the dryness level inputted by the user through the key input unit 66, i.e., the current drying operation, corresponds to one of the levels consisting of "normal dry", "less dry", and "damp dry" (S130).

When it is determined that the inputted dryness level corresponds to one of the above levels, the microcomputer 64 counts the frequency of the case in which the inputted voltage (V) is higher than the reference voltage (Vs) for a predetermined time (approximately 1 minute), i.e., the frequency of the number of "1" (S140).

The microcomputer 64 determines whether or not the counted frequency is in a predetermined range according to individual dryness levels (S150). For example, in the case that the desired dryness level, set by the user, is "normal dry", it is determined that the drying operation in a state, in which the remaining moisture content is 3~5%, is completed only when the counted frequency for 1 minute is 0 as shown in FIG. 5. In the case that the desired dryness level, set by the user, is "less dry", it is determined that the drying operation in a state, in which the remaining moisture content is 5~20%, is completed only when the counted frequency for 1 minute is 100~200, and in the case that the desired dryness level, set by the user, is "damp dry", it is determined that the drying operation in a state, in which the remaining moisture content is 15~20%, is completed only when the counted frequency for 1 minute is 200~400.

The drying operation is continuously performed until the counted frequency corresponding to the desired dryness level, set by the user, is sensed. In the case that the counted frequency is in the predetermined range corresponding to the dryness levels, the microcomputer 64 determines that the drying operation is completed and terminates the drying using hot air (S190), performs a cooling operation for a designated time (S200), and then completely terminates the drying operation (S210).

In the case that it is determined that the dryness level during the drying operation corresponds to one of the levels consisting of "more dry" and "very dry" at step S130, the laundry is first dried to the level of "normal dry". That is, the microcomputers 64 performs the drying operation until the counted frequency of the number "1" for 1 minute is 0, and then senses time (Tn) taken to perform the above drying operation (S160).

When the drying operation is performed up to the level of "normal dry", the microcomputer 64 calculates additional drying time by multiplying the time taken to perform the drying operation by a predetermined coefficient. Assuming that it takes 30 minutes to perform the drying operation until the level of "normal dry", the additional drying times to reach the levels of "more dry" and "very dry" are respectively obtained by multiplying the above time by coefficients of 0.1~0.2 and 0.2~0.4 (S170). The obtained additional drying times to reach the levels of "more dry" and "very dry" are respectively 3~6 minutes and 6~12 minutes.

Thereafter, the drying operation is additionally performed during either one of the above additional drying times according to the dryness levels ("more dry" and "very dry") (S180), and then the drying using hot air is terminated (S190). When the drying is completed, the cooling operation is performed for a designated time (S200), and then the drying operation is completely terminated (S210).

As described above, the clothing drying machine of the exemplary embodiment of the present invention performs drying operation according to various dryness levels.

As apparent from the above description, the exemplary embodiment of the present invention provides a clothing drying machine, which terminates drying operation when a dryness level of clothing reaches a target dryness level (target remaining moisture content) desired by a user.

The clothing drying machine of the exemplary embodiment of the present invention precisely senses a low dryness level of clothing having high remaining moisture content as well as a high dryness level of clothing having low remaining moisture content, thereby sensing the optimum dryness level of the clothing according to user's tastes and preventing damage to the clothing or loss of electric power due to excessive drying of the clothing.

Although an exemplary embodiment of the invention has been shown and described, it would be appreciated by those skilled in the art that changes may be made in this exemplary embodiment without departing from the principles and spirit of the invention, the scope of which is defined in the claims and their equivalents.

What is claimed is:

1. A clothing drying machine comprising:

an electrode sensor that senses a voltage, wherein said voltage varies according to a moisture content of laundry;

a counting unit that counts a number of times that the voltage sensed by the electrode sensor is more than a predetermined reference voltage; and a control unit that terminates a drying operation when the number of times counted by the counting unit for a predetermined reference time is within a range of one of predetermined dryness levels;

wherein the control unit, when a dryness level set when the drying operation is started is more than a predetermined reference dryness level of the predetermined dryness levels:

performs the drying operation for a drying time until the number of times counted by the counting unit is in the range of the predetermined reference dryness level, additionally performs the drying operation for a time obtained by multiplying the drying time by a predetermined coefficient, and terminates the drying operation.

2. The clothing drying machine as set forth in claim 1, wherein said predetermined dryness levels comprise a higher dryness level and a lower dryness level, when the drying operation is started, one of the higher dryness level and the lower dryness level is set, and a number of times counted within a range of the higher dryness level is less than a number of times counted within a range of the lower dryness level.

3. A method for sensing a dryness level using a clothing drying machine comprising:

counting a number of times that a voltage sensed by an electrode sensor is more than a predetermined reference voltage, wherein the voltage varies according to a moisture content of laundry; and terminating a drying operation when the number of times counted by the counting unit for a predetermined reference time is within a range of one of predetermined dryness levels;

wherein when a dryness level set when the drying operation is started is more than a predetermined reference dryness level of the predetermined dryness levels, the drying operation is performed for a drying time until the number of times counted by the counting unit is within the range of the predetermined reference dryness level, the drying operation is additionally performed for a time obtained by multiplying the drying time by a predetermined coefficient, and then the drying operation is terminated.

4. A method for sensing a dryness level using a clothing drying machine comprising:

allowing an electrode sensor to sense a voltage, wherein the voltage varies according to a moisture content of laundry; and determining a dryness level corresponding to a number of times that the sensed voltage is within a predetermined range;

wherein when a dryness level, set when the drying operation is started, is more than a predetermined reference dryness level, the drying operation is performed for a reference drying time until the sensed voltage is not more than the reference voltage for the predetermined reference time, and the drying operation is additionally performed for a predetermined additional drying time;

wherein the a additional drying time is obtained by multiplying the reference drying time by a predetermined coefficient.

5. The method as set forth in claim 4, wherein in the predetermined range, the sensed voltage is more than a predetermined reference voltage.

6. The method as set forth in claim 5, wherein the dryness level is one of predetermined dryness levels, the predetermined dryness levels comprising a higher dryness level and a lower dryness level, and wherein a number of times counted within a range of the higher dryness level is less than a number of times counted within a range of the lower dryness level.

7. The method as set forth in claim 5, wherein it is determined that drying operation is completed when the number of times that the sensed voltage is more than the reference voltage, for a predetermined reference time, is within a predetermined range.

8. The method as set forth in claim 4, wherein the coefficient is set to one of different values according to a dryness level set when the drying operation is started.

* * * * *